US009135887B2

(12) United States Patent
Jun et al.

(10) Patent No.: US 9,135,887 B2
(45) **Date of Patent: *Sep. 15, 2015**

(54) DISPLAY DEVICE AND DRIVING METHOD OF THE SAME

(71) Applicant: SAMSUNG DISPLAY CO., LTD., Yongin-si, Gyeonggi-do (KR)

(72) Inventors: Byung-Geun Jun, Yongin (KR); Min-Cheol Kim, Yongin (KR); In-Hwan Kim, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 166 days.

This patent is subject to a terminal disclaimer.

(21) Appl. No.: 13/759,995

(22) Filed: Feb. 5, 2013

(65) Prior Publication Data

US 2014/0118409 A1 May 1, 2014

(30) Foreign Application Priority Data

Oct. 26, 2012 (KR) ..... 10-2012-0119735

(51) Int. Cl.

*G09G 5/02* (2006.01)
*G09G 3/30* (2006.01)
*G09G 3/32* (2006.01)

(52) U.S. Cl.

CPC .. *G09G 5/02* (2013.01); *G09G 3/30* (2013.01); *G09G 3/3233* (2013.01); *G09G 3/3291* (2013.01)

(58) Field of Classification Search

CPC ..... G09G 5/02; G09G 2300/0842; G09G 2310/0251; G09G 2330/028; G09G 3/3233; G09G 3/3291; G09G 2320/043; G09G 2320/0233; G09G 2360/147; G09G 3/006; G09G 3/30; G09G 2360/16; G09G 3/3208

USPC ..... 345/36, 39, 45, 76–83, 690, 204–214; 315/169.3

See application file for complete search history.

(56) References Cited

U.S. PATENT DOCUMENTS

2006/0262130 A1* 11/2006 Kim et al. ..... 345/589
2007/0040770 A1* 2/2007 Kim ..... 345/76

(Continued)

FOREIGN PATENT DOCUMENTS

JP 2008-281821 A 11/2008
KR 10-2007-0052461 A 5/2007
KR 10-2007-0088232 A 8/2007
KR 10-2009-0010826 A 1/2009

(Continued)

*Primary Examiner* — Hong Zhou

(74) *Attorney, Agent, or Firm* — Christie, Parker & Hale, LLP

(57) ABSTRACT

A display device includes: a display panel including scan lines, data lines, and color pixels located at crossing regions of the scan lines and the data lines, each of the color pixels including a driving transistor, the color pixels including first color pixels, second color pixels, and third color pixels; a scan driver configured to transfer a scan signal; a data driver configured to transfer an image data signal; an initialization voltage controller configured to set different initialization voltages for each pixel during each frame according to a threshold voltage deviation for the driving transistor of each pixel and calculate the initialization voltages including first, second, and third initialization voltages corresponding to the plurality of color pixels; an initialization voltage driver configured to apply the calculated first, second, and third initialization voltages; and a signal controller configured to generate and transfer a control signal and the image data signals.

22 Claims, 8 Drawing Sheets

(56) References Cited

U.S. PATENT DOCUMENTS

| | | | | |
|---|---|---|---|---|
| 2011/0141084 | A1* | 6/2011 | Kishi | 345/211 |
| 2012/0062545 | A1* | 3/2012 | Kim | 345/212 |
| 2012/0146999 | A1* | 6/2012 | Hwang | 345/419 |

FOREIGN PATENT DOCUMENTS

| | | | |
|---|---|---|---|
| KR | 10-2009-0131042 | A | 12/2009 |
| KR | 10-2010-0075132 | A | 7/2010 |
| KR | 10-2012-0000434 | A | 1/2012 |

* cited by examiner (a)

(b)

DISPLAY DEVICE AND DRIVING METHOD OF THE SAME

CROSS-REFERENCE TO RELATED APPLICATION

This application claims priority to and the benefit of Korean Patent Application No. 10-2012-0119735 filed in the Korean Intellectual Property Office on Oct. 26, 2012, the entire disclosure of which is incorporated herein by reference.

BACKGROUND (a) Field

Embodiments of the present invention relate to a display device and a driving method thereof.

(b) Description of the Related Art

An organic light emitting diode display, which is a type of flat panel display apparatus, displays an image by using an organic light emitting diode which generates light by recombining electrons and holes. The organic light emitting diode display has a rapid response speed, low power consumption, and excellent emission efficiency, luminance, and viewing angles, and thus has received much attention.

Generally, organic light emitting diode displays are classified into passive matrix organic light emitting diode displays (PMOLEDs) and active matrix organic light emitting diode displays (AMOLEDs) according to a driving mode (or driving method) of the organic light emitting display.

The passive matrix type OLED display (PMOELD) uses a driving mode in which a positive electrode and a negative electrode are formed to cross each other, with an organic light emitting diode coupled between the positive electrode and the negative electrode and wherein the organic light emitting diode emits light when the negative electrode and the positive electrode line are concurrently driven, and the active matrix type OLED display (AMOELD) uses a driving mode in which a thin film transistor and a capacitor are integrated in each pixel to maintain (or store) a voltage in the capacitor. The passive matrix type OLED display has a simple structure and is relatively inexpensive, but it is difficult to implement a large-sized or high-precision panel. On the other hand, the active matrix type OLED display may implement the large-sized or high-precision panel, but controlling AMOLED displays is technically difficult and the costs are relatively high.

In view of its resolution, contrast, and operation speed, the active matrix type organic light emitting diode display (AMOLED) in which light is selectively emitted for each unit pixel has become mainstream.

In one pixel of the active matrix OLED (hereinafter, referred to as an organic light emitting diode display), the emission degree (or brightness or gray level) of the organic light emitting diode is controlled by controlling a driving transistor which supplies a driving current to the organic light emitting diode according to data voltage.

In a display panel of the organic light emitting diode display, differences in the threshold voltages and current mobilities among a plurality of driving transistors may occur. The differences may occur due to characteristics of the materials (e.g., the polysilicon), and manufacturing process, method, and environment of the driving transistors. In addition, the differences may occur due to deterioration of the driving transistor as the organic light emitting diode display is used over time.

Although the same data voltage is applied to each pixel circuit, the output emission degrees (e.g., brightnesses or gray levels) of the pixels vary due to non-uniformities in the threshold voltage characteristics of the driving transistors. Accordingly, a spot phenomenon (that may appear as, for example, relatively dark, sand-like particles) occurs on a bright screen. For example, when the threshold voltages of the driving transistors are not uniform, although the same data voltage is applied, the gate-source voltage Vgs output of the driving transistors, which is directly associated with a driving current supplied to the organic light emitting diode, varies. Accordingly, an accurate gray level is not expressed according to a data signal and a spot occurs, and, as a result, the quality of the display is deteriorated.

Technology for correcting for image degradation through the compensation of threshold voltage variation of the driving transistors has been developed, but recently, as display panels have grown in size and thus the display panel is driven at a higher speed, there are problems in that a compensation time is limited (e.g., the time available for compensation is short) and gray spots of the display panel may proliferate.

The above information disclosed in this Background section is only for enhancement of understanding of the background of the invention and therefore it may contain information that does not form the prior art that is already known in this country to a person of ordinary skill in the art.

SUMMARY

Embodiments of the present invention have been made in an effort to provide a display device having features of implementing more accurate gray level expression and improved image quality in accordance with data signals by compensating for gray spots caused by variations in threshold voltages of driving transistors of pixels and by removing (or reducing) a crosstalk phenomenon from occurring when using a common initialization voltage.

Embodiments of the present invention have been made in an effort to provide a method of driving a display device capable of compensating for gray spots to implement high-quality display images by controlling the supply of an initialization (or initializing) voltage to pixels displaying each color of red, green, and blue (RGB) and capable of reducing a time required for compensating for variations (or deviations) in threshold voltages of the driving transistors of pixels displaying each color.

An exemplary embodiment of the present invention provides a display device, including: a display panel including a plurality of scan lines, a plurality of data lines, and a plurality of color pixels located at crossing regions of the scan lines and the data lines, each of the color pixels including a driving transistor, the color pixels including a plurality of first color pixels, a plurality of second color pixels, and a plurality of third color pixels; a scan driver configured to transfer a plurality of scan signals to the plurality of scan lines connected to corresponding ones of the color pixels; a data driver configured to transfer a plurality of image data signals to the plurality of data lines connected to corresponding ones of the color pixels; an initialization voltage controller configured to set different initialization voltages for each pixel of the plurality of color pixels during each frame in accordance with a threshold voltage deviation of the driving transistor of each pixel and calculate the set initialization voltages, the initialization voltages including a first initialization voltage corresponding to the plurality of first color pixels, a second initialization voltage corresponding to the plurality of second color pixels, and a third initialization voltage corresponding to the plurality of third color pixels; an initialization voltage driver configured to apply the calculated first, second, and third initialization voltages through a plurality of initialization voltage wires connected to each pixel of the display panel; and a signal controller configured to generate and to transfer the plurality of image data signals to the data driver and a control signal to control operations of the scan driver, the data driver, and the initialization voltage controller.

The initialization voltage wires may include a first initialization voltage wire configured to apply the first initialization voltage corresponding to the plurality of first color pixels to the plurality of first color pixels, a second initialization voltage wire configured to apply the second initialization voltage corresponding to the plurality of second color pixels to the plurality of second color pixels, and a third initialization voltage wire configured to apply the third initialization voltage corresponding to the plurality of third color pixels to the plurality of third color pixels.

The first initialization voltage wire coupled to the plurality of first color pixels, the second initialization voltage wire coupled to the plurality of second color pixels, and the third initialization voltage wire coupled to the plurality of third color pixels may be coupled to the initialization voltage driver, respectively.

Each of the color pixels of the display panel may be connected to a corresponding one of the scan lines and a previous scan line of the scan lines, and each of the color pixels may be configured to receive the corresponding initialization voltage among the first, second, and third initialization voltages calculated in the initialization voltage controller in response to a first scan signal transferred through the previous scan line.

Each of the color pixels may be configured to receive a corresponding image data signal among the plurality of image data signals transferred through the data driver when a second scan signal is transferred through the corresponding one of the scan lines.

Each of the color pixels may be configured to apply a corresponding one of the first, second, and third initialization voltages to a gate electrode of a corresponding driving transistor to initialize data voltages.

The initialization voltage controller may include a variation measuring unit configured to measure the threshold voltage deviation of a driving transistor of each of the color pixels by analyzing luminance emitted by the display panel in accordance with a test initialization voltage applied to each of the color pixels; and an initialization voltage setting unit configured to calculate the different initialization voltages of each of the color pixels for each frame in accordance with the threshold voltage deviation of the driving transistor and calculate the first, second, and third initialization voltages in accordance with the initialization voltage during one frame.

The initialization voltage controller may further include a storing unit configured to storing luminance analysis information in accordance with test initialization voltage and the test data voltage received from the variation measuring unit.

The variation measuring unit may be configured to compare actual luminance with a target luminance of the test data voltage and to categorize the deviation of the threshold voltage of the driving transistor in accordance with the degree of deviation from a threshold range of the target luminance.

The initialization voltage setting unit may be configured to calculate the first, second, and third initialization voltages so that, after initializing the color pixels, when the same data voltage is applied to each of the first, second, and third color pixels, the gate electrode voltages of the driving transistors of the first, second, and third color pixels have the same voltage.

The initialization voltage controller may be configured to transfer initialization voltage information regarding the calculated first, second, and third initialization voltages to the initialization voltage driver and control the operation of the initialization voltage driver.

Each of the color pixels of the display panel may include an organic light emitting diode configured to emit light in accordance with a driving current of an image data signal corresponding to each of the color pixels, a switching transistor configured to transfer a data voltage corresponding to the image data signal to a gate electrode of the driving transistor, a threshold voltage compensation transistor configured to diode-connect a gate electrode with a drain electrode of the driving transistor to compensate for the threshold voltage of the driving transistor, and an initialization transistor configured to receive an initialization voltage corresponding to each of the color pixels among the first, second, and third initialization voltages calculated in the initialization voltage controller and received from the initialization voltage driver to transfer the received initialization voltage to the gate electrode of the driving transistor, wherein the driving transistor is configured to transfer the driving current to the organic light emitting diode in accordance with the image data signal.

Each of the color pixels of the display panel may further include a storage capacitor coupled between the gate electrode of the driving transistor and a driving power source voltage supply source of the pixel.

Each of the color pixels of the display panel may further include a hold capacitor coupled between the gate electrode of the driving transistor and the gate electrode of the switching transistor and configured to maintain the corresponding initialization voltage transferred from the initialization transistor for a period (e.g., a predetermined period).

The initialization transistor may be configured to control a switching operation when a scan signal is transferred through a previous scan line.

Another exemplary embodiment of the present invention provides a method of driving a display device including a plurality of pixels, the pixels including a plurality of first color pixels, a plurality of second color pixels, and a plurality of third color pixels, wherein each of the pixels includes an organic light emitting diode and a driving transistor configured to transfer a driving current to the organic light emitting diode in accordance with an image data signal. The driving method includes: initializing a previous frame data voltage written in a gate electrode of the driving transistor; compensating for a threshold voltage of the driving transistor; transferring the image data signal to the driving transistor; and emitting light from the organic light emitting diode in accordance with the driving current in accordance with the image data signal.

The initializing may include displaying a test image by applying a test initialization voltage and a test data voltage to each pixel; measuring a deviation of the threshold voltage of the driving transistor of each of the pixels by analyzing a luminance emitted when displaying the test image; setting different initialization voltages for initializing the driving of each pixel for each frame in accordance with the deviation of the threshold voltage of the driving transistor and calculating the set initialization voltages as a first initialization voltage corresponding to the plurality of first color pixels, a second initialization voltage corresponding to the plurality of second color pixels, and a third initialization voltage corresponding to the plurality of third color pixels; and applying the calculated first, second, and third initialization voltages respectively through a first initialization voltage wire, a second initialization voltage wire, and a third initialization voltage wire respectively connected to the first color pixels, the second color pixels, and the third color pixels.

The plurality of first, second, and third color pixels may be arranged on the display device such that different color pixels are continuously arranged and form a repeating pattern.

The displaying the test image and the measuring the deviation of the threshold voltage may be performed repeatedly by changing the test initialization voltage and the test data voltage.

The measuring the deviation of the threshold voltage may include storing luminance analysis information analyzed from the test image in accordance with the test initialization voltage and the test data voltage.

The measuring the deviation of the threshold voltage includes measuring the luminance, comparing the luminance with a target luminance of the test data voltage, and categorizing the pixels in accordance with a degree of deviation from a threshold range of the target luminance.

The calculating the first, second, and third initialization voltages may include calculating the first to third initialization voltages so that, after the initializing, when the same data voltages are applied to the pixels, the gate electrode voltages of the driving transistors of the first, second, and third color pixels are the same as each other, by reflecting a voltage level changed according to the first, second, and third color pixels for the same gray level data voltage.

In the display device according to the exemplary embodiments of the present invention, it is possible to reduce or prevent the appearance of gray spots of a display image due to a deviation of threshold voltage of a driving transistor of a pixel included in a display panel device and to reduce or remove a crosstalk phenomenon through a supply control of initialization voltage to implement high-quality and clear image quality.

Further, it is possible to compensate for gray spots by controlling the supply of initialization voltage for a display image of a pixel displaying each color of red, green, and blue and to reduce a time required for compensation of variations in the threshold voltages of the driving transistors of a pixel displaying each color for each color pixel. Accordingly, it is possible to provide a stable driving method improving image quality of a display device because a high-speed driving method using a separate frame memory or sub frame is not required for the compensation of the gray spots.

DETAILED DESCRIPTION

Figure 1:
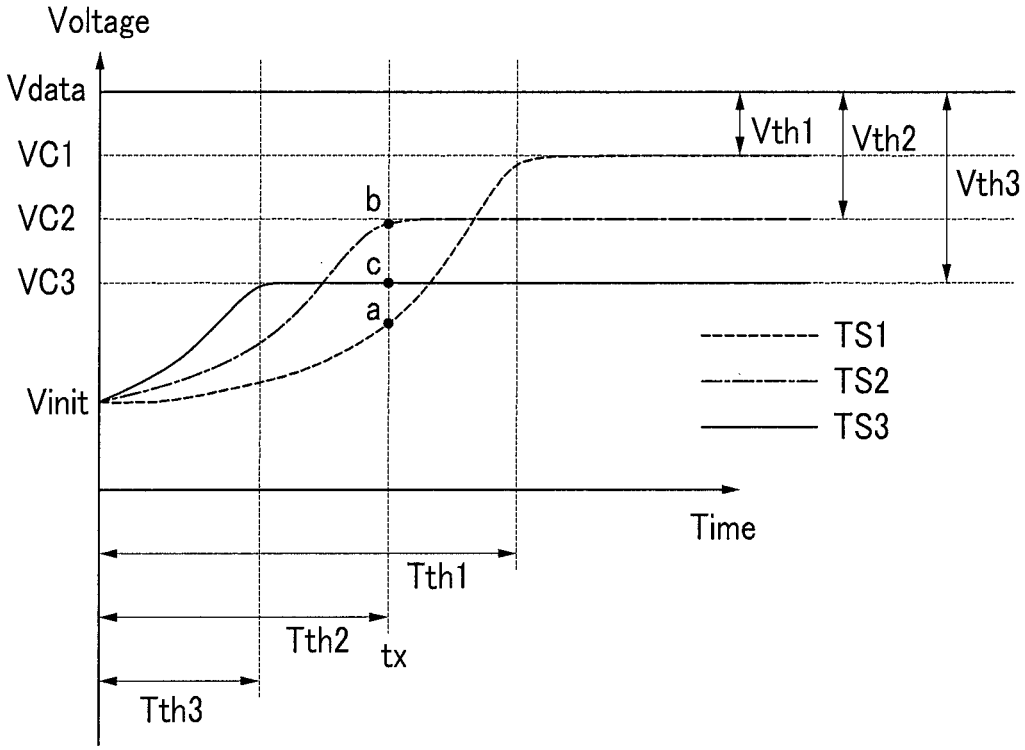
FIG. 1 is a graph illustrating a relationship between threshold voltage variation and a compensation time of a driving transistor of a pixel in a display device in the related art.

Embodiments of the present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention.

The drawings and description are to be regarded as illustrative in nature and not restrictive. Like reference numerals designate like elements throughout the specification.

Throughout this specification and the claims that follow, when an element is described as being "coupled" to another element, the element may be "directly coupled" to the other element or "electrically coupled" to the other element through a third element. Further, unless explicitly described to the contrary, the word "comprise" and variations such as "comprises" or "comprising" will be understood to imply the inclusion of stated elements but not the exclusion of any other elements.

FIG. 1 is a graph illustrating a relationship between threshold voltage variation and a compensation time of a driving transistor of a pixel in a display device in the related art.

Characteristics of constituent elements vary due to factors such as characteristics, a manufacturing method, and a manufacturing environment of polysilicon configuring a base substrate in a manufacturing process of a plurality of pixels included in a display panel of a display device in the related art.

Particularly, even in circumstances in which the same data voltage is applied, the luminance of light emitted by each pixel may vary according to a characteristic of a driving transistor which controls and supplies a driving current to the organic light emitting diode of a pixel according to the supplied data voltage. Because the characteristic of the threshold voltage of the driving transistor is not uniform (e.g., not the same) for each pixel, the emission degree (e.g., brightness or luminance) of each pixel varies and the differences in luminance may cause a gray spot phenomenon that appears as dark sandy particles scattered across the display panel, which may be particularly noticeable when displaying a bright image.

In FIG. 1, pixels in which the threshold voltages of the driving transistors vary in the display panel are representatively exemplified as a first pixel TS1, a second pixel TS2 and a third pixel TS3.

In the exemplary embodiment of the present invention, it is assumed that a transistor included in the pixels is a PMOS transistor, and therefore PMOS will be mainly described. Accordingly, in the graph of FIG. 1, a data voltage (e.g., a predetermined data voltage) Vdata may be variable having a minus (e.g., negative) value. For example, in the graph of FIG. 1, an increase of a Y-axis represents an increase of an absolute value of a negative area. However, embodiments of the present invention are not limited thereto. For example, in another embodiment of the present invention, the transistor in the pixels may be an NMOS transistor and, accordingly, the data voltage Vdata may be a plus (e.g., positive) value.

In addition, threshold voltage of the driving transistor of the first pixel TS1 is VC1 which is close to the data voltage Vdata, threshold voltage of the driving transistor of the second pixel TS2 is VC2, and threshold voltage of the driving transistor of the third pixel TS3 is VC3. Accordingly, differences between the data voltage Vdata and the threshold voltage values of the driving transistors of the first, second, and third pixels are Vth1, Vth2, and Vth3.

In order to compensate the threshold voltage of each driving transistor, a gate electrode and a drain electrode of the driving transistor are diode-connected with each other and thus gate electrode voltage needs to be maintained at the respective corresponding threshold voltage values VC1, VC2, and VC3.

However, initialization voltage applied before compensation of the threshold voltage in the driving of the pixel is applied to the gate electrode of the driving transistor of the pixel.

As shown in FIG. 1, the initialization voltage Vinit was applied with the same value as the value in the related art.

As a result, a compensation period in which the initialization voltage Vinit drops to the threshold voltages VC1, VC2, and VC3 of respective driving transistors of the first, second, and third pixels varies. For example, in the driving transistor of the first pixel TS1, a compensation time taken when a current flows out from the initialization voltage Vinit to the threshold voltage VC1 is the longest as Tth1. On the other hand, in the driving transistor of the third pixel TS3, a compensation time taken when a current flows out from the initialization voltage Vinit to the threshold voltage VC3 is the shortest as Tth3.

The compensation times Tth1, Tth2, and Tth3 vary according to the threshold voltage characteristic of the corresponding driving transistor.

When the display device is driven at high speed and thus there is insufficient compensation time and the threshold voltage is compensated for the same reference compensation time (e.g., a predetermined reference compensation time) tx, a gate voltage value of the driving transistor of the second pixel TS2 reaches b and a gate voltage value of the driving transistor of the third pixel TS3 reaches c, and as a result, the threshold voltages of the second pixel TS2 and the third pixel TS3 are sufficiently compensated. However, a gate voltage value of the driving transistor of the first pixel TS1 merely reaches a and thus the threshold voltage of the first pixel TS1 is not properly compensated.

Thus, when the data voltage according to the data signal is applied to the first pixel TS1, a voltage different from intended data voltage is outputted and thus the emission degree (e.g., the luminance of the emitted light) is different from that of other pixels of the display panel that are supplied with the same data voltage. This may cause visual artifacts and defects in the display such as gray spots.

As such, the degree to which the gray spots are apparent is reduced as the difference between the data voltage and the fixed initialization voltage is decreased. In other words, the appearance of the spot is reduced as light having higher luminance is emitted from pixels using a PMOS transistor. For example, in the case where a data signal is in a low gray level, the gray spots are more easily produced in the display panel and are more easily noticed.

A phenomenon of the gray spots expression is substantially the same even in the case of RGB color data transferred to pixels expressing red, green, and blue (RGB) colors.

For example, even though the same RGB color data voltage is supplied, data voltages (e.g., gamma data voltages) applied for each of the RGB pixels are different from each other. Therefore, applying a fixed (e.g., same) initialization voltage between the RGB pixels may cause the appearance of spots.

In more detail, one method of reducing problems of gray level expression that may be caused when the initialization voltage that is fixed between the RGB pixels is applied will be described in the following drawings.

Accordingly, the display device according to the exemplary embodiment of the present invention does not use the fixed initialization voltage and instead applies an initialization voltage set according to a threshold voltage characteristic of each RGB pixel in order to reduce the appearance of gray spots due to threshold voltage deviations (or variations) of the driving transistors of the RGB pixels.

Figure 2:
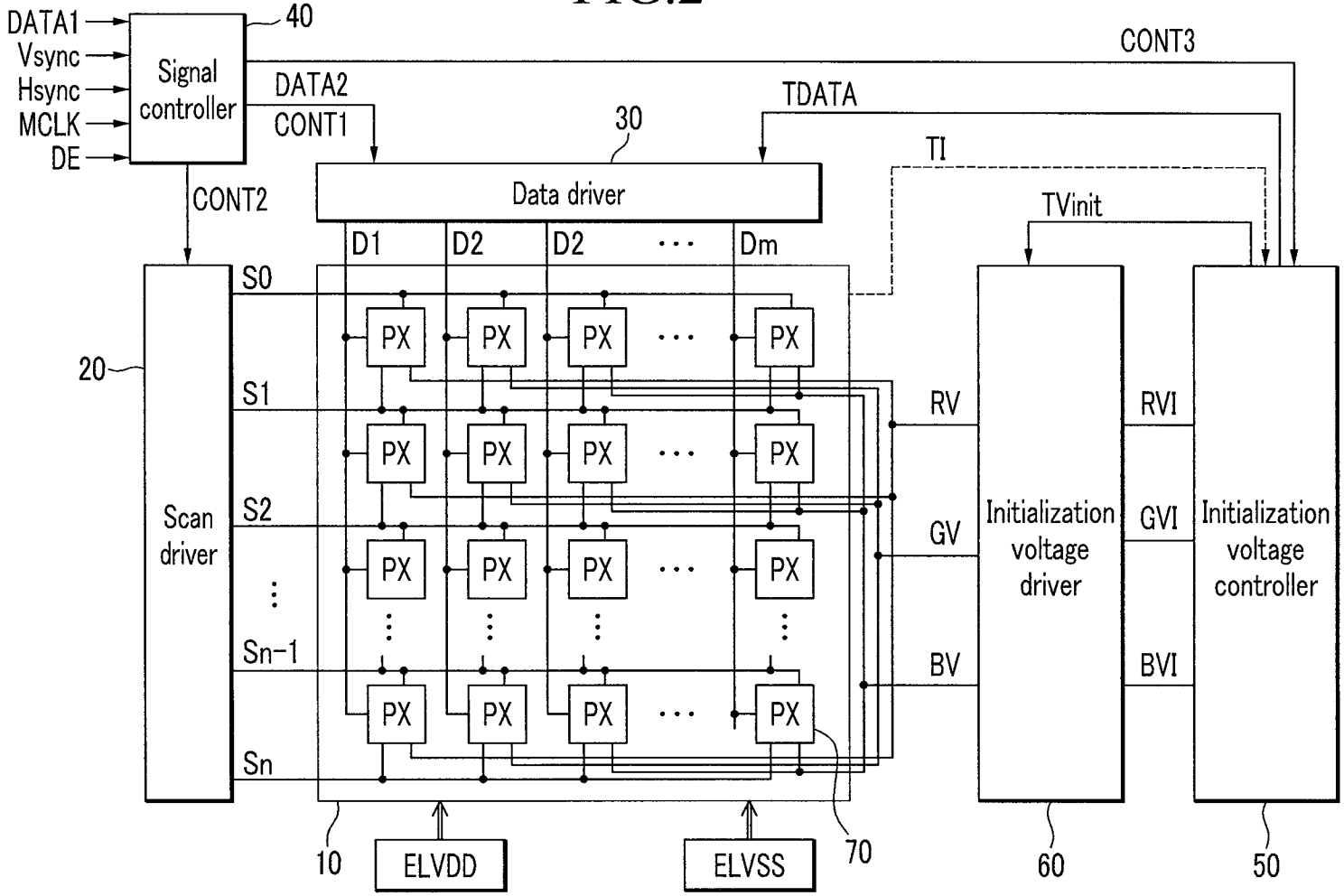
FIG. 2 is a schematic block diagram illustrating a display device according to an exemplary embodiment of the present invention.

The configuration of a display device according to one exemplary embodiment of the present invention for improving the gray spots due to the threshold voltage deviation (or variation) of the driving transistor between the RGB pixels is illustrated in FIG. 2 as a block diagram.

Referring to FIG. 2, the display device includes a display panel 10 including a plurality of pixels 70, a scan driver 20, a data driver 30, a signal controller 40, an initialization voltage controller 50, and an initialization voltage driver 60.

The display panel 10 includes the plurality of pixels 70 which are arranged in a matrix form in a plurality of crossing regions in which a plurality of scan lines S0, S1, . . . , Sn and a plurality of data lines D1, D2, . . . , Dm cross each other. The display panel 10 displays an image according to a data signal transferred through the data line.

Each of the plurality of pixels 70 is positioned in a crossing region (e.g., a predetermined region) where one of a plurality of scan lines S0-Sn arranged in a first direction and one of a plurality of data lines D1-Dm arranged in a direction perpendicular to the first direction cross each other. In addition, each of the plurality of pixels is connected with a corresponding scan line among the plurality of scan lines and a corresponding data line among the plurality of data lines. Each of the plurality of pixels displays an image (e.g., emits light) by self-emission of a light emitting diode driven by a driving current in accordance with a data signal transferred through the corresponding data line.

Further, each of the plurality of pixels is connected to a corresponding initialization voltage wire among a plurality of initialization voltage wires RV, GV, and BV connected to the initialization voltage driver 60.

In more detail, the plurality of initialization voltage wires apply different initialization voltages according to red, green, and blue RGB color pixels and are connected between the initialization voltage driver 60 and corresponding ones of the pixels of the display panel 10.

Each of the plurality of pixels 70 included in the display panel 10 is connected to an initialization voltage wire supplying an initialization voltage corresponding to a color of light emitted by the corresponding pixel.

For example, each red pixel of the plurality of pixels 70 is connected to a first initialization voltage wire RV applying initialization voltage corresponding to the red pixels. Each green pixel of the plurality of pixels is connected to a second initialization voltage wire GV applying initialization voltage corresponding to the green pixels. Further, each blue pixel of the plurality of pixels is connected to a third initialization voltage wire BV applying initialization voltage corresponding to the blue pixels.

In a display device according to the exemplary embodiment shown in FIG. 2, a display panel 10 in which the plurality of pixels 70 included in each row of pixels is arranged in the order of red, green, and blue pixels, and a plurality of first initialization voltage wires RV, second initialization voltage wires GV, and third initialization voltage wires BV are connected to respective red, green, and blue pixels but the structure of the display panel 10 is only an example and embodiments of the display panel 10 are not limited to the structure. For example, it is sufficient for the display panel of the display device of the present invention to have a structure in which separate initialization voltage wires are configured to apply initialization voltages for each of red, green, and blue pixels.

In addition, each of the plurality of pixels may receive a scan signal controlling the supply of the initialization voltage in order to receive the initialization voltage corresponding to (e.g., during) an initialization period. To this end, each pixel is connected to two scan lines of the plurality of scan lines.

For example, in one embodiment, each pixel is connected to the previous scan line of a scan line corresponding to a row of pixels including the corresponding pixel so as to receive the scan signal corresponding to the initialization period of the corresponding pixel. In one embodiment, the scan signal corresponding to the initialization period is the previous corresponding scan signal received through the previous scan line.

Further, each pixel is connected to the scan line corresponding to the row of pixels including the corresponding pixel. Accordingly, the pixel receives the corresponding scan signal through the corresponding scan line in order to be activated so as to receive a data voltage according to a data signal during a data writing period.

According to the exemplary embodiment of FIG. 2, each of the plurality of RGB pixels 70 included in the display panel 10 receives and operates on the previous scan signal received through the previous scan line of the scan lines corresponding to the row of pixels including the corresponding pixel in order to receive different initialization voltages for each color pixel. However, the pixel described herein is merely an exemplary embodiment and embodiments of the present invention are not necessarily limited to this configuration.

In another exemplary embodiment, an initialization control line transferring a corresponding initialization control signal is connected to each of the plurality of RGB pixels, and different initialization voltages are applied to each of the RGB pixels for each color pixel in accordance with the initialization control signal.

In embodiments of the present invention, different initialization voltages (e.g., predetermined different initialization voltages) are applied to each pixel of the RGB pixels to compensate for variations in the threshold voltages of the driving transistors of RGB pixels.

The scan driver 20 is connected to the plurality of scan lines S0-Sn which are connected to the plurality of pixels 70 included in the display panel 10. As described above, in one embodiment, the scan driver 20 connects two scan lines to one row of pixels. For example, a corresponding scan line corresponding to a corresponding row of pixels and the previous scan line (e.g., the scan line prior to the corresponding scan line) are connected to each of the plurality of pixels of the corresponding row of pixels. However, in the case of a first row of pixels, a dummy scan line S0 is further included, and the dummy scan line S0 and a first scan line S1 corresponding to the first row of pixels are connected to the plurality of pixels included in the first row of pixels.

In addition, the scan driver 20 generates scan signals corresponding to each of the plurality of pixels included in the display panel 10 in response to a scanning control signal CONT2 supplied from the signal controller 40 to supply the scan signals through the plurality of scan lines S1-Sn (or S0-Sn) in sequence.

The data driver 30 is connected to the plurality of data lines D1-Dm which are connected to the plurality of pixels 70 included in the display panel 10. The data driver 30 operates in accordance with a data driving control signal CONT1 supplied from the signal controller 40. Accordingly, the data signal corresponding to each of the plurality of pixels included in the display panel 10 is generated and supplied through the corresponding data line among the plurality of data lines D1-Dm. In more detail, an image data signal DATA2 obtained by image-processing an image signal DATA1 inputted from an external source is sampled and latched to be converted into gamma reference voltages in accordance with the data signals.

According to a driving method of the display device according to the exemplary embodiment of the present invention, in order to determine the initialization voltage to be transferred to each RGB pixel of the display panel for each color pixel, before the image-processed data signal DATA2 is transferred, a test data signal TDATA may be supplied to the data driver 30. The data voltage according to the test data signal TDATA is transferred to each pixel of the display panel through the data driver 30 to display a test image.

The signal controller 40 receives and analyzes the image signal DATA1 received from the outside (e.g., an external source) and performs image-processing to generate the image data signal DATA2 and transfers the generated image data signal DATA2 to the data driver 30.

Further, control signals controlling each driver of the display device are generated to be transferred to the corresponding driver. In more detail, the control signals include a scanning control signal CONT2 controlling the operation of the scan driver 20, a data driving control signal CONT1 controlling the operation of the data driver 30, and an initialization driving control signal CONT3 controlling the operation of the initialization voltage controller 50.

The signal controller 40 receives a vertical synchronization signal Vsync, a horizontal synchronization signal Hsync, a clock signal MCLK, a data enable signal DE from the outside to generate the control signals. For example, the signal controller 40 controls operation timings of the scan driver 20, the data driver 30, and the initialization voltage controller 50 by using timing signals such as the vertical synchronization signal Vsync, the horizontal synchronization signal Hsync, the data enable signal DE, and the clock signal MCLK. Because a frame period may be determined by counting the data enable signal DE for 1 horizontal period among the timing signals, in some embodiments, the vertical synchronization signal Vsync and the horizontal synchronization signal Hsync supplied from the outside may be omitted.

Further, the display device according to the exemplary embodiment of FIG. 2 includes the initialization voltage driver 60 connected to the plurality of initialization voltage wires RV, GV, and BV which are connected to corresponding ones of the plurality of RGB pixels of the display panel 10, and the initialization voltage controller 50 is connected to the initialization voltage driver 60.

The initialization voltage controller 50 is driven in accordance with the initialization driving control signal CONT3 supplied from the signal controller 40 and controls the operation of the initialization voltage driver 60.

In addition, the initialization voltage controller 50 calculates and determines different initialization voltages for each RGB pixel of the display panel. To this end, the initialization voltage controller 50 applies the test initialization voltage TVinit to the display panel and supplies the test data voltage TDATA to display the test image. Then, the initialization voltage controller 50 acquires test image information TI for each RGB pixel 70 of the display panel 10 from the test image to calculate the different initialization voltages for each RGB pixel 70. Referring to the display panel structure of the exemplary embodiment of FIG. 2, the initialization voltage determined by the initialization voltage controller 50 is based on the entire display panel displaying the image during each frame.

As the process for differently setting the initialization voltages transferred for each color pixel of the display panel, the initialization voltage controller 50 measures the threshold voltage deviation (or variation) characteristic of the driving transistors in the display panel.

To this end, the initialization voltage controller 50 allows the display panel to display the test image for measuring the threshold voltage variations of the pixels in response to the initialization driving control signal CONT3 transferred from the signal controller 40.

Further, to implement the test image, the initialization voltage controller 50 may set (e.g., supply) the test data signal TDATA and the test initialization voltage TVinit.

The test data signal TDATA is transferred to the data driver 30 to display the test image before the display panel displays the image according to the image data signal DATA2. For example, the test data signal TDATA is transferred to the RGB pixels 70 through the data driver 30 and the RGB pixels 70 of the display panel 10 display the test image in response to the data voltages in accordance with the test data signal TDATA.

Further, the test initialization voltage TVinit is applied to each RGB pixel included in the display panel 10 in order to measure the characteristics of the threshold voltage variations of the driving transistors of the RGB pixels. The test initialization voltage TVinit is applied to each pixel of the display panel through the initialization voltage driver 60.

Next, the initialization voltage controller 50 acquires and analyzes image information TI from the test image displayed in the display panel 10 and then measures the threshold voltage deviation (or variation) of the driving transistor of the pixel for each RGB pixel included in the display panel. The image information TI may be luminance information of the test image when emitting light at a data voltage in response to the test initialization voltage according to the test data signal.

The initialization voltage controller 50 calculates different initialization voltage values for each RGB pixel according to a threshold voltage variation characteristic of the display panel by using the image information TI.

The initialization voltage information regarding the initialization voltage value calculated for each RGB pixel is transferred to the initialization voltage driver 60. The initialization voltage controller 50 transfers the information regarding the initialization voltages which are differently determined for each RGB pixel to the initialization voltage driver 60 to control the driving of the initialization voltage driver.

The initialization voltage information includes initialization voltage information RVI applied to a red pixel, initialization voltage information GVI applied to a green pixel, and initialization voltage information BVI applied to a blue pixel.

In another exemplary embodiment of the present invention, when the initialization control signal controlling the supply of the initialization voltage applied through the initialization voltage driver 60 for each RGB pixel is transferred through a separate control line, the initialization voltage controller 50 is configured to generate and transfer the initialization control signal.

In the exemplary embodiment of supplying the initialization voltage according to the control of the initialization control signal, the initialization voltages may be differently supplied for each pixel area (e.g., each predetermined pixel area). For example, the pixel area may be a pixel unit, a row of pixels including a plurality of pixels, or a pixel block unit including a plurality of pixels and the initialization control signal may be transferred to the pixels included in the pixel area to supply different initialization voltages to the pixel area. In this case, in the exemplary embodiment of the present invention, the initialization voltages applied to the pixel area may be differently set for each RGB pixel included in the pixel area.

However, because the display device according to the exemplary embodiment of FIG. 2 uses a scan signal transferred through the scan line corresponding to the previous row of pixels of the corresponding row of pixels to control the supply of the initialization voltage, the initialization voltages are differently (e.g., separately) determined and applied for each frame. In addition, the initialization voltages, which are differently (e.g., separately) applied for each frame, are differently (e.g., separately) calculated for each RGB pixel included in the entire display panel again to be applied to each of the plurality of RGB pixels of the display panel through the initialization voltage wire.

The detailed configuration and the function of the initialization voltage controller 50 according to the exemplary embodiment of FIG. 2 will be described below with reference to FIG. 4.

The initialization voltage driver 60 distributes and applies different initialization voltages for each color pixel to each of the plurality of RGB pixels of the display panel 10 through a plurality of initialization voltage wires, for example, a first initialization voltage wire RV, a second initialization voltage wire GV, and a third initialization voltage wire BV (as shown in FIG. 2).

The initialization voltage driver 60 distributes reference voltage based on the initialization voltage information applied to the red, green, and blue pixels to supply the corresponding initialization voltage for each RGB pixel.

According to an exemplary embodiment of the present invention, in order to measure the variation characteristic of the threshold voltage of the driving transistor for each RGB pixel, the image information may be acquired by setting an area (e.g., a predetermined area) of the display panel and displaying the test image through the area (e.g., the predetermined area). In this case, the area may be defined by a row of pixels including at least one of a red pixel, a green pixel, and a blue pixel, a block unit including a plurality of rows of pixels, or the entire display unit driven in one frame. The initialization voltage controller 50 of one embodiment of the present invention may differently (e.g., separately) calculate the initialization voltages for each color pixel that are determined based on a voltage level changed for each color pixel again after determining the different initialization voltages according the predetermined area.

Figure 3:
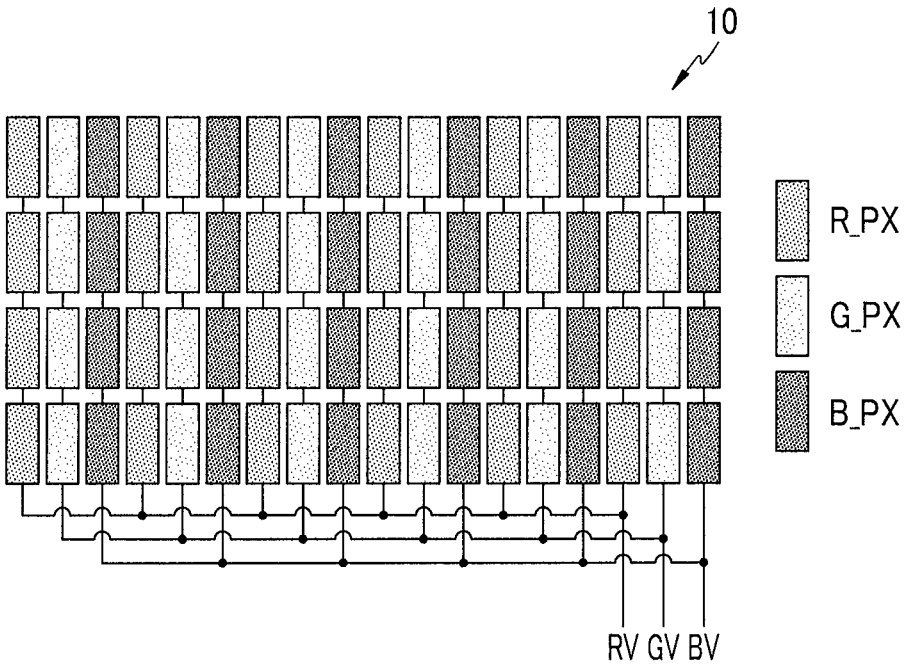
FIG. 3 is a diagram schematically illustrating a structure of a display panel of the display device of the embodiment of FIG. 2.

FIG. 3 is a diagram schematically illustrating a structure of the display panel 10 of the display device of FIG. 2.

As illustrated in FIG. 3, the display panel 10 has a structure in which red pixels R_PX, green pixels G_PX, and blue pixels B_PX are repeatedly arranged in one row of pixels in sequence, and the display panel includes a plurality of rows of pixels in which red, green, and blue pixels are arranged.

Each of the plurality of red pixels R_PX is connected to a first initialization voltage wire RV, each of the plurality of green pixels G_PX is connected to a second initialization voltage wire GV, and each of the plurality of blue pixels B_PX is connected to a third initialization voltage wire BV.

The initialization voltages for each color pixel, which are differently (or separately) calculated in order to compensate for the variations (or distribution) in the threshold voltages of the driving transistors of the color pixels are transferred through the first initialization voltage wire RV, the second initialization voltage wire GV, and the third initialization voltage wire BV.

Figure 4:
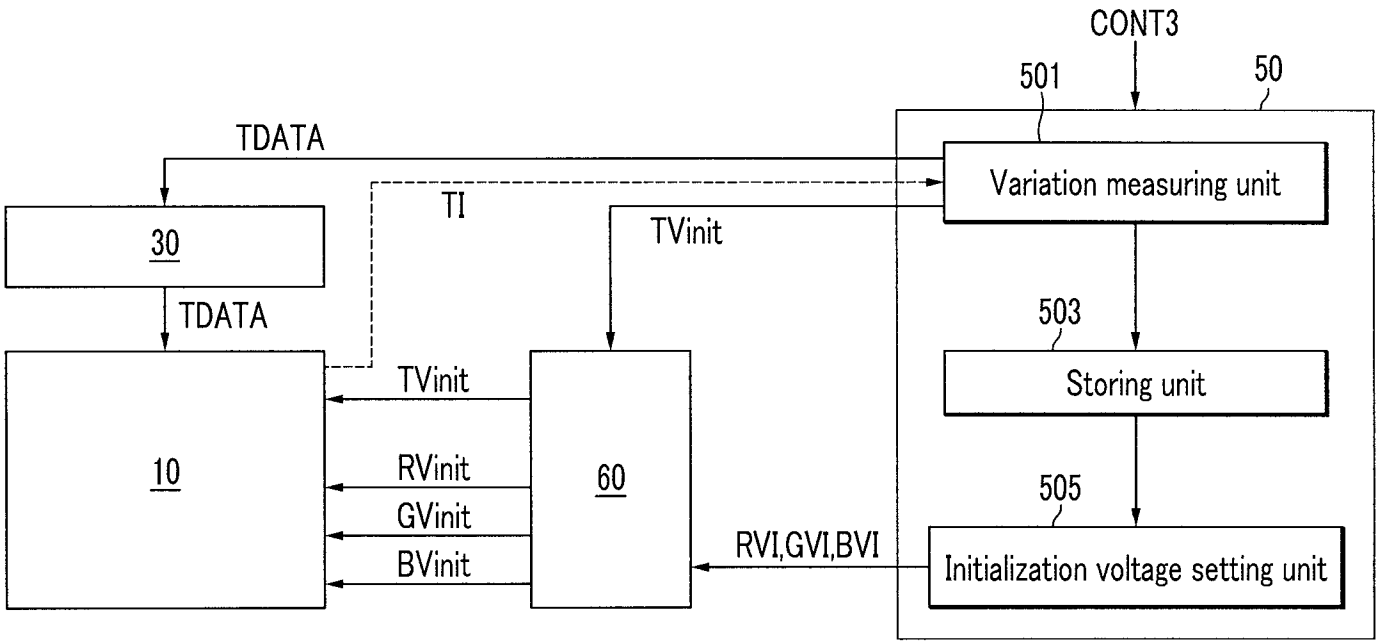
FIG. 4 is a block diagram schematically illustrating a configuration and a method of operation of an initialization voltage controller of the display device of the embodiment of FIG. 2.

In the display device of FIG. 2, the detailed configuration and method of operation of the initialization voltage controller 50 are schematically illustrated in the block diagram of FIG. 4.

Referring to FIG. 4, the initialization voltage controller 50 includes a variation measuring unit 501, a storing unit 503, and an initialization voltage setting unit 505.

The initialization voltage controller 50 operates according to the control of the initialization driving control signal CONT3 transferred from the signal controller 40.

The variation measuring unit 501 of the initialization voltage controller 50 measures the deviation (variation or distribution) of the threshold voltage of the driving transistor of each of the plurality of pixels 70 included in the display panel 10.

In more detail, the variation measuring unit 501 measures the threshold voltage variation of the pixel in the entire display panel 10 for each RGB pixel, but, in another embodiment, may measure the threshold voltage variation of the driving transistors in an area (e.g., a predetermined area). The area may include at least one red pixel, one green pixel, and one blue pixel.

The variation measuring unit 501 may determine set values of the test data voltage TDATA and the test initialization voltage TVinit and supplies the test data voltage and the test initialization voltage.

The test data voltage TDATA is transferred to the display panel 10 through the data driver 30.

In one embodiment, the test data voltage TDATA is a data voltage for a test supplied to the data lines connected to the plurality of RGB pixels included in the display panel and is a data voltage having the same gray level information that allows all the pixels to emit light at the same target luminance (e.g., predetermined target luminance).

In addition, the test initialization voltage TVinit is transferred to the plurality of RGB pixels through the initialization voltage driver 60 to initialize the driving current of each of the plurality of RGB pixels 70 included in the display panel 10. In the display device of the embodiment of FIG. 2, because the display device is connected to the initialization voltage driver 60 through the first, second, and third initialization voltage wires RV, GV, and BV, the test initialization voltage TVinit is applied at a common voltage value through the first, second, and third initialization voltage wires RV, GV, and BV.

Because a method of initializing the driving of the pixels included in the display panel may be varied according to a characteristic and a type of display panel, embodiments of the present invention are not limited to any particular method by which the test initialization voltage is applied. In the exemplary embodiment of the present invention, in the case where the pixel is a self-emission element such as an organic light emitting diode element, the test initialization voltage may be applied to a control element (e.g., a driving transistor) so as to initialize the driving current transferred to the organic light emitting element as a value (e.g., a predetermined value).

When the variation measuring unit 501 transfers the test data voltage (e.g., the predetermined test data voltage) and the test initialization voltage (e.g., the predetermined test initialization voltage) to the RGB pixels 70 of the display panel 10, each of the RGB pixels 70 of the display panel 10 is initialized to the test initialization voltage and displays an image in accordance with the test data voltage.

Next, the variation measuring unit 501 acquires the test image information TI on the test image displayed in the display panel 10. For example, the variation measuring unit 501 analyzes luminance of the test image displayed in the RGB pixel area (e.g., the predetermined RGB pixel area) of the display panel 10. In more detail, the actual luminance values of the RGB pixels are measured as compared with a target luminance corresponding to the test data voltage value. As used herein, the term "target luminance" means target luminance when the light is ideally emitted in accordance with gray level information corresponding to the test data voltage.

While separately controlling the setting of the test data signal TDATA and the test initialization voltage TVinit, the variation measuring unit 501 may repeatedly analyze the luminance from the test image of each pixel of RGB of the display panel. In this case, in another exemplary embodiment, when area (e.g., the predetermined area) is determined in the display panel, the variation measuring unit 501 differently (e.g., separately) controls the setting of the test data signal TDATA and the test initialization voltage TVinit for each area (e.g., each predetermined area) of the display panel 10 to repeatedly analyze the luminance of the test image.

In one embodiment, when the variation measuring unit 501 analyzes the luminance of the test image of the display panel, all of the driving conditions and the driving times of the display panel are fixed at all times, except for the voltage setting values (test data voltage and test initialization voltage) transferred from the variation measuring unit 501. For example, in a driving environment in which an external driving power supply, a pixel circuit structure, and wires and driving times such as an initialization time, a threshold voltage compensating time, a scan and data writing time, and a light emitting time are fixed, the test image is repeatedly displayed.

The gray level information acquired through a process of analyzing the luminance of the test image in the variation measuring unit 501 and the set voltage values are transferred to and stored in the storing unit 503.

The storing unit 503 is connected to the variation measuring unit 501, and repeatedly receives image information regarding the test image of the display panel from the variation measuring unit 501 to store the received image information in a lookup table. The lookup table stored in the storing unit 503 represents a relationship of the change in gray level information as the initialization voltages applied to the RGB pixels of the display panel are changed, as gray level values that are actually displayed in each of the plurality of RGB pixels of the display panel in response to the test data voltage having a luminance value (e.g., a predetermined luminance value).

Because the threshold voltage characteristics of the driving transistors of the respective pixels of the display panel may be different from each other, gray spots may occur in the image produced in accordance with the test data voltage. Further, because there is a characteristic difference for each RGB pixel, luminance differences may exist in the display of the test image according to the same test data voltage.

Accordingly, a threshold range (e.g., a predetermined threshold range) of the target luminance may be set, and, in accordance with the degree that actual luminance deviates from the threshold range, it may be determined that there is a threshold voltage deviation of the driving transistor of the RGB pixels in the display panel.

In another exemplary embodiment of the present invention, a level at which the actual luminance deviates from the threshold range of the target luminance is divided (or categorized) into groups (e.g., predetermined groups), and it is determined that the threshold voltage characteristics of the driving transistors of the pixels which belong to the corresponding group may be similar to each other. The groups may be, for example, a row of pixels including the RGB pixels or a block unit including the plurality of rows of pixels.

The block diagram of FIG. 4 illustrates the configuration of the initialization voltage controller 50 according to the display device of the embodiment shown in FIG. 2, the block diagram illustrates a case where the initialization voltages applied to the entire display panel including the RGB pixels are differently (e.g., separately) calculated for each frame.

Accordingly, the initialization voltage setting unit 505 may differently (e.g., separately) determine the initialization voltages applied during each frame for the entire display panel in which the RGB pixels are sequentially arranged according to the occurrence degree of the gray spots. Here, the occurrence of the gray spots means that the luminance deviation exceeds the threshold range because the driving transistor threshold voltages of the pixels included in the entire display panel are not sufficiently compensated for in each frame. The initialization voltage setting unit 505 may determine the initialization voltage of the corresponding frame at a level that the gray spots do not occur when the variation measuring unit 501 displays the image of the display panel while varying the initialization voltages.

Further, after the initialization voltage setting unit 505 calculates the initialization voltages applied for each frame, the initialization voltage setting unit 505 differently (or separately) calculates the initialization voltages that are applied respectively based on the difference of the voltage levels for each RGB pixel of the display panel.

For example, even though the RGB pixels of the display panel receive the data voltages according to the input data signals having the same gray level value, the gamma data voltages applied to the red, green, and blue pixels have different values. For example, although the data voltages according to the same input data signal of 10 grays levels are applied, the data voltages have different voltage levels in which the gamma data voltage of the red pixel is 4 V, the gamma data voltage of the green pixel is 4.1 V, and the gamma data voltage of the blue pixel is 4.2 V. Accordingly, in the display device according to the exemplary embodiment of the present invention, in order to compensate for the threshold voltage variation of each RGB pixel, the initialization voltages, which are set differently for each frame, are also calculated in accordance with the differences of the gamma data voltage levels for each color pixel.

The initialization voltage setting unit 505 calculates the initialization voltage values for compensating the threshold voltage deviation for each RGB pixel by using the gray level information on the initialization voltage of each pixel acquired by repeatedly displaying the test image for the display panel 10 and the difference of the gamma voltage levels for each RGB pixel.

The information on the calculated different initialization voltage values for each RGB pixel is transferred to the initialization voltage driver 60.

According to another exemplary embodiment of the present invention, the initialization voltage setting unit 505 may separately calculate the initialization voltages of the corresponding area for each area (e.g., predetermined area) (for example, for each row of pixels, for each block, and for each frame) in the display panel. In this case, the initialization voltage setting unit 505 determines the area of the initialization voltage control of the display panel and then may determine the initialization voltage just before the gray spots occur for each area as the actually applied initialization voltage value by using the lookup table. In addition, the initialization voltage setting unit 505 may separately calculate again the initialization voltage values determined for each area based on the different voltage levels for each RGB pixel. For example, when the gray spots are differently expressed in a first row of pixels, a second row of pixels, and a third row of pixels as an area (e.g., a predetermined area), for example, an area corresponding to one row of pixels, the initialization voltage setting unit 505 sets a control target area of the initialization voltage by a unit of a row of pixels and may determine the initialization voltage applied to each row of pixels.

In the example, because the threshold voltages of the driving transistors of the pixels included in the first row of pixels, the second row of pixels, and the third row of pixels are different from each other, although the display panel is driven, for the same compensating and driving time, the gray spots of the image displayed for each row of pixels may differently occur. In this case, the initialization voltage setting unit 505 determines different initialization voltages for each row of pixels so that all the threshold voltages are compensated for during the same compensating time. Further, in order to compensate for the difference of the gamma data voltages due to the characteristic difference of the RGB pixels included in the row of pixels, the initialization voltage setting unit 505 also calculates the determined initialization voltages for each RGB pixel to operate the calculated initialization voltages so as to apply the control connected for each color pixel.

In FIG. 4, the initialization voltage setting unit 505 transfers the information RVI, GVI, and BVI regarding the initialization voltages calculated for each RGB pixel to the initialization voltage driver 60 again with respect to the initialization voltages which are differently calculated for each frame.

Then, the initialization voltage driver 60 transfers the initialization voltage RVinit according to the initialization voltage information RVI on the red pixel for each RGB pixel of the display panel 10, the initialization voltage GVinit according to the initialization voltage information GVI on the green pixel, and the initialization voltage BVinit according to the initialization voltage information BVI on the blue pixel through the corresponding initialization voltage wires.

Figure 5:
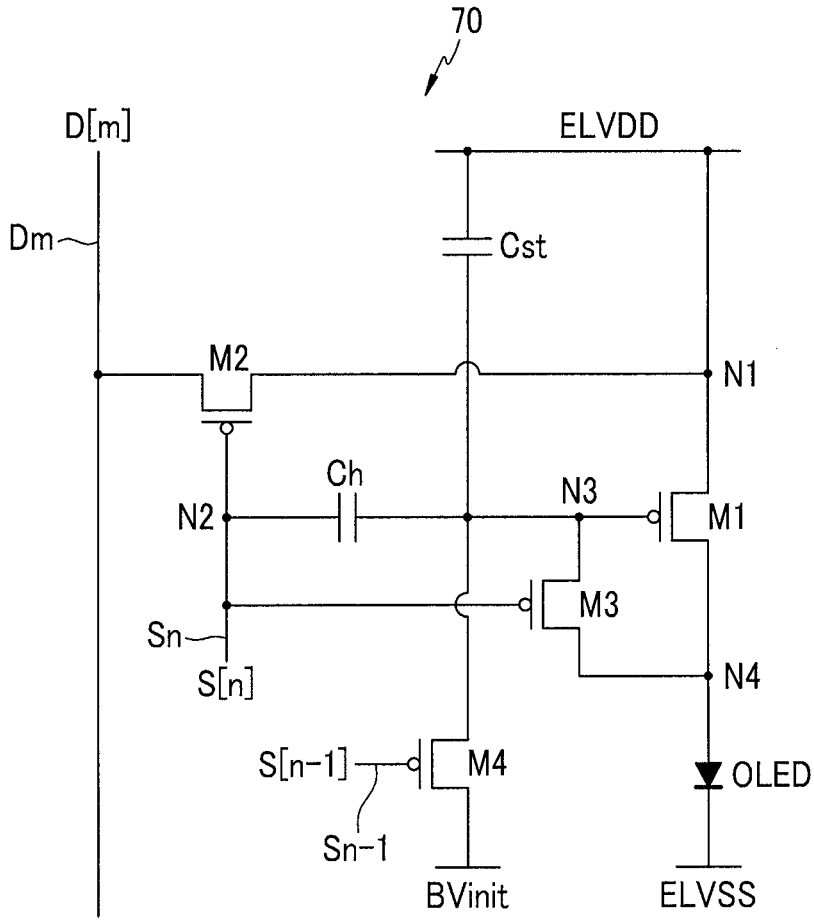
FIG. 5 is a circuit diagram illustrating a configuration of a pixel included in the display panel of the display device of the embodiment of FIG. 2.

FIG. 5 is a circuit diagram illustrating the configuration of the pixel 70 included in the display panel 10 of the display device of FIG. 2. In more detail, FIG. 5 is a circuit diagram illustrating a representative circuit structure of the pixel included in the display panel which is the target of the threshold voltage deviation compensation according to the exemplary embodiment of the present invention.

Referring to the pixel circuit diagram of FIG. 5, the initialization voltages calculated and applied as different voltage values for each RGB pixel are applied and thus the threshold voltage deviation of the driving transistor is compensated, and as a result, the gray spots of the display image are reduced or prevented. In more detail, for the sake of convenience, the pixel of FIG. 5 is described as a blue pixel in an m-th column among the plurality of pixels included in an n-th row of pixels, but embodiments of the present invention are not limited to the exemplary embodiment and may be variously configured with a circuit element which may perform the function of compensating the threshold voltage deviation according to the present invention.

The pixel of FIG. 5 includes an organic light emitting diode (OLED) and a driving circuit driving the organic light emitting diode (OLED), and the driving circuit includes four transistors M1, M2, M3, and M4 and two capacitors Cst and Ch.

In the pixel circuit of FIG. 5, at least one light emission control transistor controlling a driving current flowing into the organic light emitting diode (OLED) by the light emission control signal is additionally included to achieve a structure including six transistors and two capacitors (which may be referred to as a "6TR2CAP" structure).

The pixel circuit of FIG. 5 is positioned in an area in which an n−1-th scan line Sn−1, an n-th scan line Sn, and an m-th data line Dm cross each other in the display device of FIG. 2 and relates to the pixel 70 connected to the third initialization voltage wire BV connected to the n−1-th scan line Sn−1, the n-th scan line Sn, and the m-th data line Dm and the blue pixel.

The image compensation of the display panel including pixels as shown in the exemplary embodiment of FIG. 5 is performed by separately controlling the initialization voltages applied to a gate terminal of the driving transistor transferring the driving current of the organic light emitting diode according to each color pixel.

In more detail, the pixel of FIG. 5 includes an organic light emitting diode (OLED) and a driving transistor M1 transferring the driving current to the organic light emitting diode (OLED). In addition, the pixel includes a switching transistor M2, a threshold voltage compensation transistor M3, an initialization transistor M4, a storage capacitor Cst, and a hold capacitor Ch.

The driving transistor M1 includes a gate electrode connected to a third node N3, a first electrode connected to a driving power source voltage ELVDD supply source of a high level supplied from the outside (in other words, connected to a first node N1), and a second electrode connected to an anode of the organic light emitting diode (OLED) (in other words, connected to a fourth node N4). When the driving transistor M1 is turned on, the driving current of the data voltage in accordance with the data signal written in the third node N3 is transferred to the organic light emitting diode (OLED) to emit light having a luminance (e.g., a predetermined luminance).

The switching transistor M2 includes a gate electrode connected to the n-th scan line Sn corresponding to the row of pixels including the pixel 70 of FIG. 5 among the plurality of scan lines (in other words, connected to the second node N2), and a first electrode connected to the corresponding m-th data line Dm among the plurality of data lines, and a second electrode connected to the first node N1. When the switching transistor M2 is turned on, data voltage D[m] according to a data signal is transferred to the first node N1 connected with the first electrode of the driving transistor M1 through the data line Dm.

In addition, the switching transistor M2 may transfer the test image data voltage TDATA set and supplied in the initialization voltage controller 50 in order to calculate the initialization voltage for compensating the threshold voltage deviation (or variation) before transferring the data voltage D[m] according to the data signal. To this end, each pixel of the display panel may include a separate initialization voltage calculation period before a data writing period when the data voltage according to the data signal is transferred. Accordingly, all the scan signals transferred to each pixel of the entire display panel may be transferred at a gate-on voltage level during the initialization voltage calculation period to turn on the switching transistor M2 of each pixel. Then, the switching transistor M2 of each pixel included in the display panel transfers the test image data voltage TDATA to the driving transistor, and the organic light emitting diode (OLED) may emit light at the driving current in accordance with the test image data voltage TDATA. As described above, the test image information required for the initialization voltage calculation may be acquired by displaying the test image in accordance with the test image data voltage TDATA in the display panel.

The threshold voltage compensation transistor M3 includes a gate electrode connected to the n-th scan line Sn among the plurality of scan lines corresponding to the row of pixels including the pixel 70 of FIG. 5 (in other words, connected to the second node N2), a first electrode connected to the third node N3 connected with the gate electrode of the driving transistor M1, and a second electrode connected to the fourth node N4 connected to the second electrode of the driving transistor M1.

A scan signal S[n] corresponding to the row of pixels including the corresponding pixel 70 through the n-th scan line Sn is transferred at a gate-on voltage level and thus the switching transistor M2 and the threshold voltage compensation transistor M3 are concurrently turned on. When the threshold voltage compensation transistor M3 is turned on, the driving transistor M1 becomes a diode by connecting the gate electrode and the second electrode (in other words, M1 is diode-connected). Then, the gate electrode and the drain electrode of the driving transistor M1 are diode-connected to each other and the storage capacitor Cst, which is connected to the gate electrode of the driving transistor M1, is charged with a voltage value corresponding to the threshold voltage of the driving transistor. Then, the threshold voltage deviation is compensated by the threshold voltage of each driving transistor, which is charged in advance when the data voltage according to the image signal is applied, to emit light at luminance according to the accurate data voltage.

In addition, the initialization transistor M4 includes a gate electrode connected to the n−1-th scan line Sn−1, which is the previous scan line of (or the scan line prior to) the scan line corresponding to the row of pixels including the corresponding pixel 70, a first electrode connected to the third initialization voltage wire BV transferring the initialization voltage BVinit corresponding to the blue pixel, and a second electrode connected to the third node N3. When the scan signal S[n−1] applied through the n−1-th scan line Sn−1 is transferred at a gate-on voltage level, the initialization transistor M4 is turned on. Accordingly, the initialization transistor M4 transfers the initialization voltage BVinit, which is calculated in the initialization voltage controller 50, to the third node N3 through the third initialization voltage wire.

Because the gate electrode of the driving transistor M1 is connected to the third node N3, the previous data voltage written in the gate electrode of the driving transistor M1 is initialized by the initialization voltage BVinit transferred to the third node N3.

The hold capacitor Ch includes a first electrode connected to the second node N2 and a second electrode connected to the third node N3. Accordingly, the initialization voltage BVinit which is calculated for the blue pixel and which is applied to the third node N3 may be maintained for the period (e.g., the predetermined period).

In addition, the storage capacitor Cst includes a first electrode connected to the driving power source voltage ELVDD supply source connected with the first electrode of the driving transistor M1 and a second electrode connected to the third node N3. Because the storage capacitor Cst is charged with the voltage according to a voltage difference applied to its two electrodes, a voltage corresponding to a difference between the voltage applied to the third node N3 and the driving power source voltage ELVDD is stored for a period (e.g., a predetermined period).

In the embodiment shown in FIG. 5, the transistor is a PMOS transistor, but in other embodiments, the transistor may be an NMOS transistor. Accordingly, in FIG. 5, the gate-on voltage turning on the transistor is at a low level (e.g., a predetermined low level), but in embodiments in which the transistor is an NMOS transistor, the gate-on voltage level is at a high level.

Figure 6:
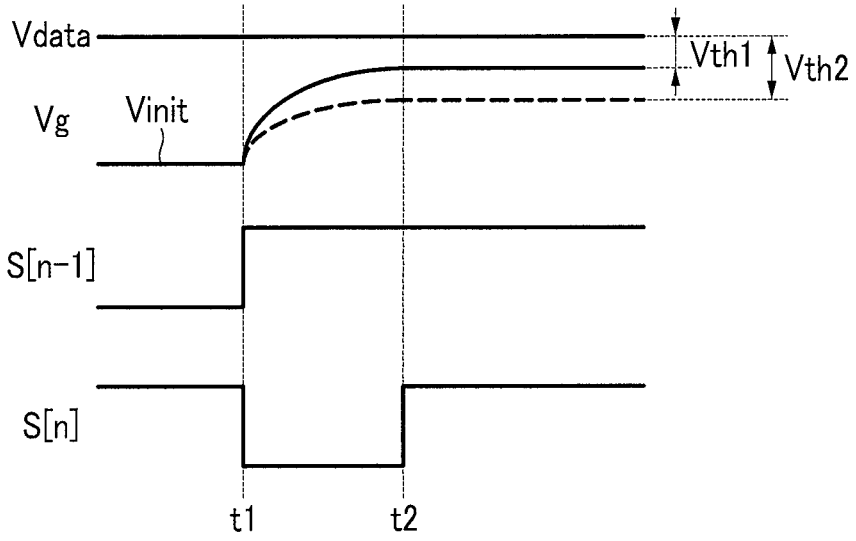
FIG. 6 is a graph illustrating a change in a compensation range of the threshold voltage of the driving transistor the pixel included in the display panel of the display device according to an embodiment of the present invention.

FIG. 6 is a graph illustrating that a compensation range of the threshold voltage of the driving transistor is generally changed in the pixel included in the display panel of the display device according to one embodiment of the present invention.

The graph of FIG. 6 will be described in reference to the pixel structure of FIG. 5.

Before a time t1, when an n−1-th scan signal S[n−1] transferred to the n−1-th scan line (which is the previous scan line of the scan line corresponding to the row of pixels including the pixel of FIG. 5) is applied in a low (e.g., low voltage) state which is a gate-on voltage level of the PMOS transistor, the initialization voltage Vinit is applied to the initialization transistor M4 of the corresponding pixel. In FIG. 5, the initialization voltage is the initialization voltage BVinit corresponding to the blue pixel calculated according to the exemplary embodiment of the present invention, but the graph of FIG. 6 illustrates a case where the initialization voltage is not controlled and a fixed initialization voltage Vinit is applied.

Then, before the time t1, the fixed initialization voltage Vinit is applied to a contact point connected to the third node N3, for example, the gate electrode of the driving transistor M1. Accordingly, gate electrode voltage Vg of the driving transistor M1 is maintained at the fixed initialization voltage Vinit.

Next, at the time t1, the n-th scan signal S[n] transferred to the n-th scan line (which is the scan line corresponding to the row of pixels including the pixel of FIG. 5) transitions to a low (voltage) state. Then, in the pixel of FIG. 5, the switching transistor M2 and the threshold voltage compensation transistor M3 are concurrently turned on. As a result, the voltage at the third node N3, that is, the gate electrode voltage Vg of the driving transistor M1, is gradually increased from the fixed initialization voltage Vinit to a voltage value corresponding to data voltage Vdata supplied through the data line Dm of the pixel. Then, the storage capacitor Cst connected to the third node N3 starts to be gradually charged. The gate electrode voltage Vg of the driving transistor M1 is increased by a voltage value Vdata−Vth1 obtained by subtracting threshold voltage Vth1 of the driving transistor from the data voltage Vdata because of the diode connection of the driving transistor M1 due to the threshold voltage compensation transistor M3. As illustrated in the graph of FIG. 6, because the threshold voltages are different from each other for each pixel of the general display device, the threshold voltage of another pixel may be different, illustrated in FIG. 6 as voltage Vth2.

Accordingly, although the data voltages according to the image signal transferred to each pixel of the display device are the same as each other, the voltage Vg applied to the gate electrode of the driving transistor for the data writing period becomes Vdata−Vth due to process variation of the threshold voltage (referred to as Vth as a representative value) of the driving transistor included in each pixel to be different from each other for each pixel.

Figure 7:
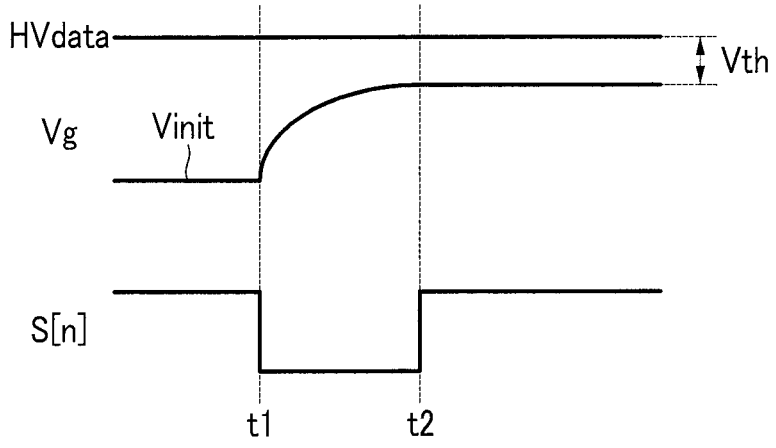
FIG. 7 is a graph illustrating the compensation of threshold voltage of a driving transistor for each gray level of data voltage applied to a pixel in the display device according to an exemplary embodiment of the present invention.
Figure 7:
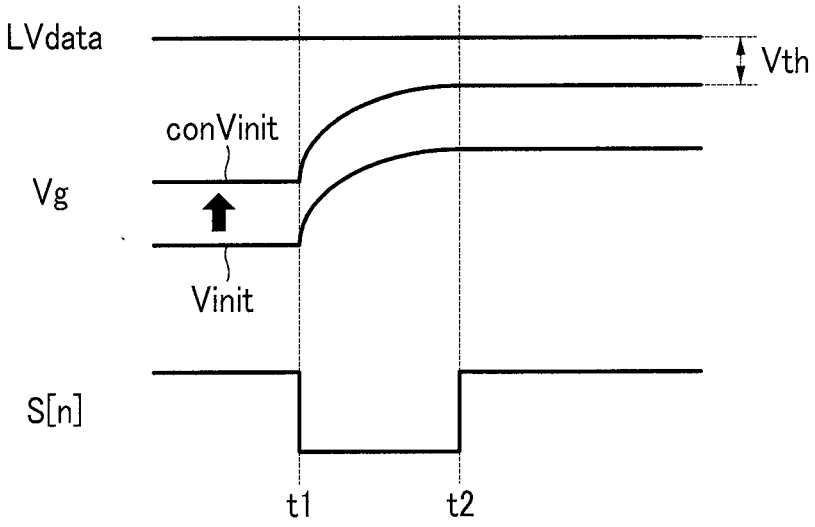

The problem due to the threshold voltage variation (or deviation) of the driving transistor may occur for each gray level of the data voltage applied to the pixel of the display device as illustrated in the graph of FIG. 7.

FIG. 7 illustrates that the compensation degree of the threshold voltage is changed according to a high gray level (graph (a)) or a low gray level (graph (b)) of the data voltage applied to the pixel of the display device and thus the initialization voltages need to be differently controlled according to a gray level range.

In FIG. 7, the scan signal S[n−1] of the n−1-th scan line transferred in order to apply the fixed initialization voltage Vinit is described in FIG. 6, and thus description thereof will not be repeated.

In FIG. 7, in both the graph (a) illustrating the case where the high-gray level data voltage HVdata is applied and the graph (b) illustrating the case where the low-gray level data voltage LVdata is applied, the fixed initialization voltage Vinit is applied.

However, because the high gray level data voltage HVdata and the low gray level data voltage LVdata have different voltage levels (the low gray level data voltage LVdata value is larger than the high gray level data voltage HVdata value), as illustrated in the graph (b) of FIG. 7, as the low gray level data voltage is applied, the threshold voltage compensation of the pixel is insufficient.

Therefore, in order for the threshold voltage compensation of the driving transistor to be sufficiently performed even in the case of applying the low gray level data voltage LVdata, the initialization voltage is controlled as a value (e.g., a predetermined value) in the case of the low gray level data voltage LVdata, that is, the initialization voltage is increased to apply controlled initialization voltage conVinit as shown in (b).

As described above, in the display device according to the exemplary embodiment of the present invention, the initialization voltage controller 50 may calculate the controlled voltage conVinit so that the threshold voltage compensation of the driving transistor may be sufficiently performed, in the case where the low gray level data voltage LVdata is applied. Luminance deviation for the low gray level is reduced or disappears when using the controlled initialization voltage conVinit.

However, in embodiments of the present invention, the initialization voltage value is calculated in accordance with the voltage level changed for each RGB pixel in addition to the deviation compensation of the threshold voltage according to the gray level voltage of the image data signal.

Figure 8:
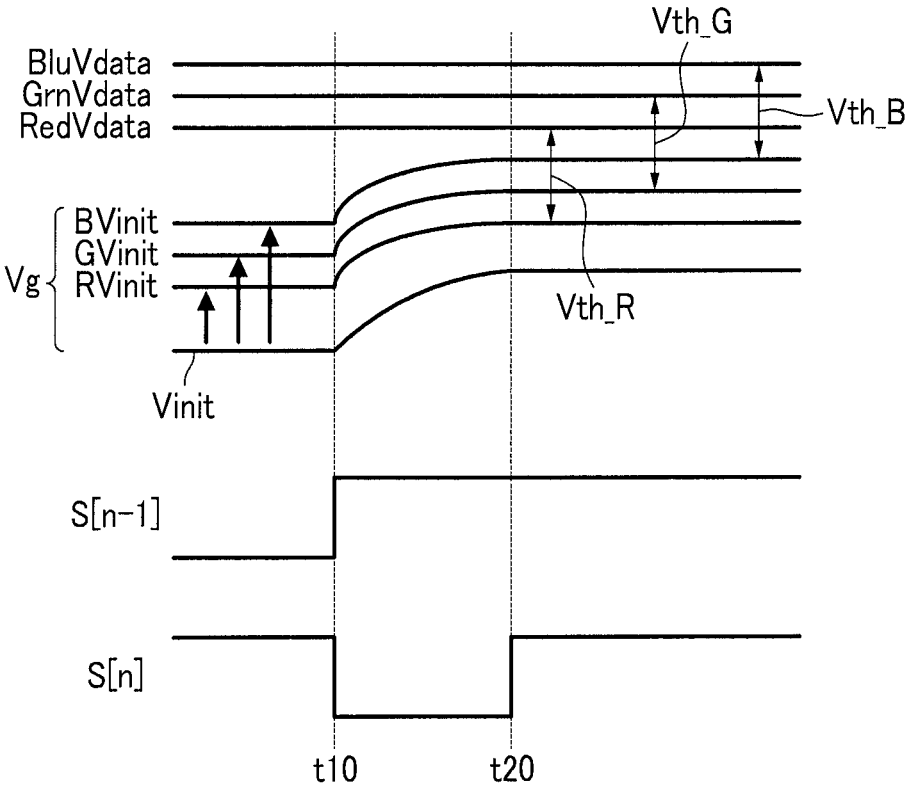
FIG. 8 is a graph illustrating deviation compensation of threshold voltage of driving transistors for each RGB pixel of the display device according to an exemplary embodiment of the present invention.

FIG. 8 is a graph illustrating deviation compensation of threshold voltage of a driving transistor for each RGB pixel of the display device according to the exemplary embodiment of the present invention. FIG. 8 briefly illustrates a method of compensating threshold voltage of a driving transistor by controlling the initialization voltage for each RGB pixel in the display device according to the exemplary embodiment of the present invention.

For example, in the case where the data voltage having a 256 gray level range is applied, when the fixed initialization voltage Vinit for the RGB pixels is applied in response to the n−1-th scan signal S[n−1], the gate electrode voltage Vg of the driving transistor of each RGB pixel does not finally have the same Vdata−Vth voltage value. For example, although the same input data voltage is applied, the gamma data voltage values applied to the RGB pixels are different from each other as determined using the lookup table.

As illustrated in FIG. 8, although an input data signal displaying the same gray level is applied, data voltage RedVdata of the red pixel is lowest and data voltage BluVdata of a blue pixel is highest. In order to compensate for the deviation of the threshold voltage compensation due to a difference of the voltage levels, the display device according to the exemplary embodiment of the present invention calculates the initialization voltages applied for each RGB pixel in the initialization voltage controller 50.

For example, the display device of the present invention calculates the initialization voltages for each color pixel according to the voltage level characteristics of the RGB pixels, that is, the initialization voltage RVinit applied to the red pixel, the initialization voltage GVinit applied to the green pixel, and the initialization voltage BVinit applied to the blue pixel as indicated by an arrow in the fixed initialization voltage Vinit and applies the calculated initialization voltages for each RGB pixel. Then, finally, the Vdata−Vth value which is the gate electrode voltage Vg of the driving transistor of each RGB pixel is the same as RedVdata−Vth_R for the red pixel, GrnVdata−Vth_G for the green pixel, and BluVdata−Vth_B for the blue pixel as illustrated in the graph of FIG. 8, and as a result, the gray level expression due to the deviation of the threshold voltage for each color pixel is accurately improved.

The drawings referred to and described in the detailed description of the present invention above only illustrate selected embodiments of the present invention, and are intended to describe the present invention, not to restrict the meanings or the scope of the present invention claimed in the claims. Therefore, those skilled in the art can easily select and substitute the drawings and disclosed description. Those skilled in the art can omit some of the constituent elements described in the present specification without deterioration in performance thereof or can add constituent elements to improve performance thereof. Furthermore, those skilled in the art can modify the sequence of the steps of the method described in the present specification depending on the process environment or equipment. Therefore, the scope of the present invention must be determined by the scope of the claims and equivalents thereof, not by the described embodiments.

<Description of selected reference numerals>

| | |
|---|---|
| 10: Display panel | 20: Scan driver |
| 30: Data driver | 40: Signal controller |
| 50: Initialization voltage controller | 60: Initialization voltage driver |
| 70: Pixel | |
| 501: Variation measuring unit | 503: Storing unit |
| 505: Initialization voltage setting unit | |

What is claimed is:

1. A display device, comprising:

a display panel comprising:

a plurality of scan lines;

a plurality of data lines; and a plurality of color pixels located at crossing regions of the scan lines and the data lines, each of the color pixels comprising a driving transistor, the color pixels comprising:

a plurality of first color pixels;

a plurality of second color pixels; and a plurality of third color pixels;

a scan driver configured to transfer a plurality of scan signals to the plurality of scan lines connected to corresponding ones of the color pixels;

a data driver configured to transfer a plurality of image data signals to the plurality of data lines connected to corresponding ones of the color pixels;

an initialization voltage controller configured to:

set different initialization voltages for each pixel of the plurality of color pixels during each frame in accordance with a threshold voltage deviation of the driving transistor of each pixel and calculate the initialization voltages separately for each frame, the initialization voltages comprising:

a first initialization voltage corresponding to the plurality of first color pixels;

a second initialization voltage corresponding to the plurality of second color pixels; and a third initialization voltage corresponding to the plurality of third color pixels;

an initialization voltage driver configured to apply the calculated first, second, and third initialization voltages through a plurality of initialization voltage wires connected to each pixel of the display panel; and a signal controller configured to generate and to transfer:

the plurality of image data signals to the data driver; and a control signal to control operations of the scan driver, the data driver, and the initialization voltage controller.

2. The display device of claim 1, wherein the initialization voltage wires comprise:

a first initialization voltage wire configured to apply the first initialization voltage corresponding to the plurality of first color pixels to the plurality of first color pixels, a second initialization voltage wire configured to apply the second initialization voltage corresponding to the plurality of second color pixels to the plurality of second color pixels, and a third initialization voltage wire configured to apply the third initialization voltage corresponding to the plurality of third color pixels to the plurality of third color pixels.

3. The display device of claim 2, wherein:

the first initialization voltage wire coupled to the plurality of first color pixels, the second initialization voltage wire coupled to the plurality of second color pixels, and the third initialization voltage wire coupled to the plurality of third color pixels are connected to the initialization voltage driver.

4. The display device of claim 1, wherein:

each of the color pixels of the display panel is connected to a corresponding one of the scan lines and a previous scan line of the scan lines, and each of the color pixels is configured to receive the corresponding initialization voltage among the first, second, and third initialization voltages calculated by the initialization voltage controller in response to a first scan signal transferred through the previous scan line.

5. The display device of claim 4, wherein:

each of the color pixels is configured to receive a corresponding image data signal among the plurality of image data signals transferred through the data driver when a second scan signal is transferred through the corresponding one of the scan lines.

6. The display device of claim 1, wherein:

each of the color pixels is configured to apply a corresponding one of the first, second, and third initialization voltages to a gate electrode of a corresponding driving transistor to initialize data voltages.

7. The display device of claim 1, wherein the initialization voltage controller comprises:

a variation measuring unit configured to measure the threshold voltage deviation of a driving transistor of each of the color pixels by analyzing luminance emitted by the display panel in accordance with a test initialization voltage and a test data voltage applied to each of the color pixels; and an initialization voltage setting unit configured to:

calculate the initialization voltages of each of the color pixels for each frame in accordance with the threshold voltage deviation of the driving transistor and calculate the first, second, and third initialization voltages in accordance with the initialization voltage during one frame.

8. The display device of claim 7, wherein the initialization voltage controller further comprises a storing unit configured to store luminance analysis information in accordance with the test initialization voltage and the test data voltage received from the variation measuring unit.

9. The display device of claim 7, wherein the variation measuring unit is configured to compare actual luminance with a target luminance of the test data voltage and to categorize the deviation of the threshold voltage of the driving transistor in accordance with the degree of deviation from a threshold range of the target luminance.

10. The display device of claim 7, wherein the initialization voltage setting unit is configured to calculate the first, second, and third initialization voltages so that, after initializing the color pixels, when the same data voltage is applied to each of the first, second, and third color pixels, gate electrode voltages of the driving transistors of the first, second, and third color pixels have the same voltage as each other by reflecting a voltage level changed according to the first to the third color pixels for the same gray data voltage.

11. The display device of claim 1, wherein the initialization voltage controller is configured to transfer initialization voltage information regarding the calculated first, second, and third initialization voltages to the initialization voltage driver to control the operation of the initialization voltage driver.

12. The display device of claim 1, wherein each of the color pixels of the display panel comprises:

an organic light emitting diode configured to emit light in accordance with a driving current of an image data signal corresponding to each of the color pixels, a switching transistor configured to transfer a data voltage corresponding to the image data signal to a gate electrode of the driving transistor, a threshold voltage compensation transistor configured to diode-connect a gate electrode with a drain electrode of the driving transistor to compensate for the threshold voltage of the driving transistor, and an initialization transistor configured to receive an initialization voltage corresponding to each of the color pixels among the first, second, and third initialization voltages calculated in the initialization voltage controller and received from the initialization voltage driver to transfer the received initialization voltage to the gate electrode of the driving transistor, wherein the driving transistor is configured to transfer the driving current to the organic light emitting diode in accordance with the image data signal.

13. The display device of claim 12, wherein: each of the color pixels of the display panel further comprises a storage capacitor coupled between the gate electrode of the driving transistor and a driving power source voltage supply source of the pixel.

14. The display device of claim 12, wherein each of the color pixels of the display panel further comprises a hold capacitor coupled between the gate electrode of the driving transistor and the gate electrode of the switching transistor and configured to maintain the corresponding initialization voltage transferred from the initialization transistor for a period.

15. The display device of claim 12, wherein the initialization transistor is configured to control a switching operation when a scan signal is transferred through a previous scan line.

16. A method of driving a display device comprising a plurality of pixels, the pixels comprising a plurality of first color pixels, a plurality of second color pixels, and a plurality of third color pixels, wherein each of the pixels comprises an organic light emitting diode and a driving transistor configured to transfer a driving current to the organic light emitting diode in accordance with an image data signal, the driving method comprising:

initializing a previous frame data voltage written in a gate electrode of the driving transistor;

compensating for a threshold voltage of the driving transistor;

transferring the image data signal to the driving transistor; and emitting light from the organic light emitting diode in accordance with the driving current in accordance with the image data signal, wherein the initializing comprises:

displaying a test image by applying a test initialization voltage and a test data voltage to each pixel;

measuring a deviation of the threshold voltage of the driving transistor of each of the pixels by analyzing a luminance emitted when displaying the test image;

setting different initialization voltages for initializing the driving of each pixel for each frame in accordance with the deviation of the threshold voltage of the driving transistor and calculating the set initialization voltages as a first initialization voltage corresponding to the plurality of first color pixels, a second initialization voltage corresponding to the plurality of second color pixels, and a third initialization voltage corresponding to the plurality of third color pixels; and applying the calculated first, second, and third initialization voltages respectively through a first initialization voltage wire, a second initialization voltage wire, and a third initialization voltage wire respectively connected to the first color pixels, the second color pixels, and the third color pixels.

17. The driving method of a display device of claim 16, wherein the plurality of first, second, and third color pixels are arranged on the display device such that different color pixels are continuously arranged and form a repeating pattern.

18. The driving method of a display device of claim 16, wherein the initialization voltage wires comprise:

a first initialization voltage wire configured to apply the first initialization voltage corresponding to the plurality of first color pixels to the plurality of first color pixels, a second initialization voltage wire configured to apply the second initialization voltage corresponding to the plurality of second color pixels to the plurality of second color pixels, and a third initialization voltage wire configured to apply the third initialization voltage corresponding to the plurality of third color pixels to the plurality of third color pixels.

19. The driving method of a display device of claim 16, wherein the displaying the test image and the measuring the deviation of the threshold voltage are performed repeatedly by changing the test initialization voltage and the test data voltage.

20. The driving method of a display device of claim 16, wherein the measuring the deviation of the threshold voltage comprises storing luminance analysis information analyzed from the test image in accordance with the test initialization voltage and the test data voltage.

21. The driving method of a display device of claim 16, wherein the measuring the deviation of the threshold voltage comprises:

measuring the luminance;

comparing the luminance with a target luminance of the test data voltage; and categorizing the pixels in accordance with a degree of deviation from a threshold range of the target luminance.

22. The driving method of a display device of claim 16, wherein the calculating of the first, second, and third initialization voltages comprises calculating the first, second, and third initialization voltages so that, after the initializing, when the same data voltages are applied to the pixels, the gate electrode voltages of the driving transistors of the first, second, and third color pixels are the same as each other by reflecting a voltage level changed according to the first, the second, and the third color pixels for the same gray level data voltage.

* * * * *